US005669578A

United States Patent [19]

Ma

[11] Patent Number: 5,669,578

[45] Date of Patent: Sep. 23, 1997

[54] CRUSH-PROOF EXTRUSION CORE

[75] Inventor: Ming Ma, Miamisburg, Ohio

[73] Assignee: NCR Corporation, Dayton, Ohio

[21] Appl. No.: 532,199

[22] Filed: Sep. 22, 1995

[51] Int. Cl.[6] ..... B65H 75/10

[52] U.S. Cl. ..... 242/613.5

[58] Field of Search ..... 242/613.4, 613.5, 242/610.6, 118.31, 118.32, 118.7, 118.8, 118.4, 118.1, 118.11, 118.2

[56] References Cited

U.S. PATENT DOCUMENTS

| | | | |
|---|---|---|---|
| 3,447,674 | 6/1969 | Fraser | 242/613.5 |
| 3,627,220 | 12/1971 | Vogel | 242/613.5 |
| 4,083,508 | 4/1978 | Pattillo | 242/613.4 |
| 5,252,369 | 10/1993 | Akao et al. | 242/613.5 |
| 5,513,820 | 5/1996 | Meyer | 242/613.5 |

FOREIGN PATENT DOCUMENTS

| | | | |
|---|---|---|---|
| 1059095 | 7/1979 | Canada | 242/613.5 |

*Primary Examiner*—John M. Jillions

[57] ABSTRACT

A core includes coaxial inner and outer tubes having a plurality of ribs extending therebetween defining a plurality of empty pockets. The inner tube has a thickness which is at least as large as the thickness of the outer tube for increasing crushing resistance of the core. In a preferred embodiment, each of the pockets includes four corners having a radius greater than the thicknesses of the inner or outer tubes or both.

9 Claims, 2 Drawing Sheets

CRUSH-PROOF EXTRUSION CORE

BACKGROUND OF THE INVENTION

The present invention relates generally to cores for supporting paper products, and, more specifically, to radial extrusion cores.

Paper rolls come in various sizes and configurations for various applications. In one exemplary application, paper rolls are used in a printer such as those commonly found in cash register machines. Industry standards typically define the envelope dimensions for both the paper roll and the required core around which the roll is wound. The core has a specified outer and inner diameter so that it may be interchangeably mounted to a corresponding spindle in a printer for supporting and dispensing the paper from the roll as required.

A typical core for cash register paper is a radial extrusion core conventionally manufactured by extruding a suitable plastic, such as high impact polystyrene extrusion grade material, for forming cores in a continuous manufacturing process. The cores are preferably made as light as possible for reducing cost, and in one conventional design the core includes concentric inner and outer tubes integrally joined together by a plurality of circumferentially spaced apart ribs which define empty pockets therebetween which reduce weight and therefore cost of the core. The inner and outer tubes and the ribs have respective thicknesses which are preferably made as small as possible for ensuring a lightweight core, but must also be adequate for providing sufficient strength in the core to prevent crushing thereof during transportation and handling. In the typical extrusion process for manufacturing the cores, molten plastic is formed under pressure through a suitable die to form the outer and inner tubes and the ribs therebetween. The extruded tube must be suitably cooled to solidify the plastic. However, the typical cooling process for solidifying the extruded cores requires that the thickness of the inner tube be suitably less than the thickness of the outer tube so that the inner tube and the outer tube may be cooled fairly evenly to ensure acceptable roundness of the core.

Paper rolls, including the cores contained therein, are usually packed in cases of multiple rolls, with handling or dropping of the cases during shipment generating compressive crushing loads across the cores which should be absorbed by the cores without undesirable permanent crushing thereof. However, experience has shown that standard radial extrusion cores used for paper rolls often crush during transportation, especially when loading or unloading the carton boxes containing the paper rolls.

Two exemplary standard radial extrusion core sizes may be referred to simply as big and small, with corresponding outer and inner diameters of 1.0 inch and 0.69 inch for the former and 0.85 inch and 0.45 inch for the latter. Both cores have substantially the same thicknesses for the outer and inner tubes and the rib, i.e. 22 mils, 10 mils, and 16 mils, respectively. The pockets defined between adjacent ribs and respective portions of the outer and inner tubes have four corresponding corners with a radius of curvature of about 10 mils. And, there are typically twelve equally spaced apart ribs in the core which define twelve corresponding weight reducing pockets. Accordingly, the big and small cores are substantially structurally identical except for the different outer and inner diameters thereof which are fixed by industry specifications for being mounted in standard printers.

In order to improve the crushing resistance of the big and small cores, one attempt was made to simply increase the various thicknesses of the outer and inner tubes and the ribs while maintaining the specified outer and inner diameters. However, this merely increased the mass of the cores, and increased the cost of materials therefor, without an acceptable increase in crushing strength.

Accordingly, it is desirable to effect an improved radial extrusion core having increased crushing strength, and preferably without substantially increasing the mass thereof.

SUMMARY OF THE INVENTION

A core includes coaxial inner and outer tubes having a plurality of ribs extending therebetween defining a plurality of empty pockets. The inner tube has a thickness which is at least as large as the thickness of the outer tube for increasing crushing resistance of the core. In a preferred embodiment, each of the pockets includes four corners having a radius greater than the thicknesses of the inner or outer tubes or both.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
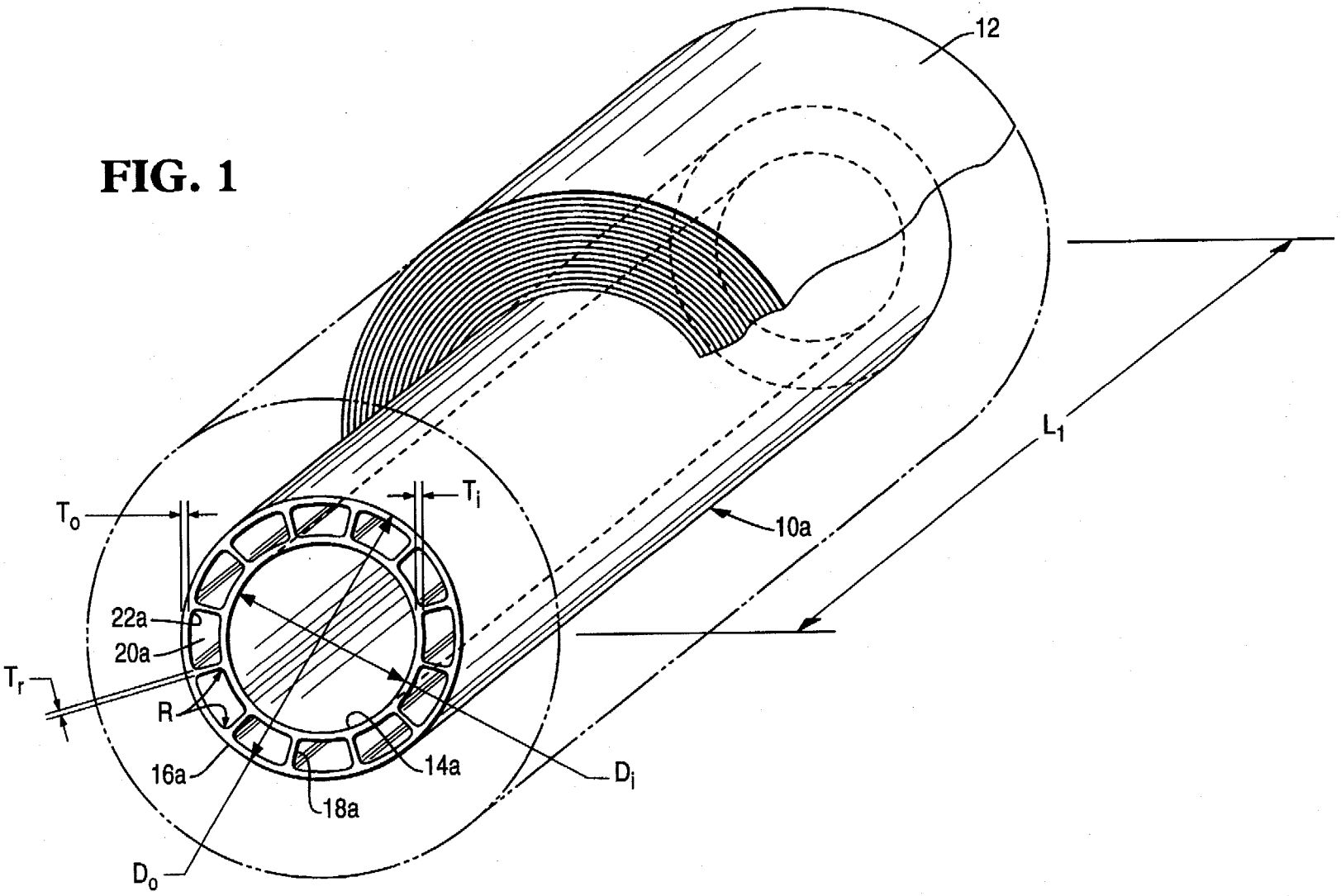
FIG. 1 is an isometric view of an exemplary radial extrusion big core in accordance with one embodiment of the present invention showing a portion of a paper roll thereon.

Illustrated in FIG. 1 is an exemplary embodiment of a radial extrusion core 10*a* in accordance with one embodiment of the present invention which supports thereon a roll of paper 12, such as cash register paper tape, a portion of which is illustrated. The core 10*a* includes a radially inner ring or tube 14*a* having an inner diameter $D_i$ and a radial wall thickness which is designated herein as the inner thickness $T_i$. The core 10*a* further includes a radially outer ring or tube 16*a* disposed coaxially with the inner tube 14*a* and spaced radially outwardly therefrom, and has an outer diameter $D_o$ and a radial wall thickness designated herein as the outer thickness $T_o$. The outer and inner diameters $D_o$ and $D_i$ of the core 10*a* are typically fixed by industry standards, and in the exemplary embodiment are 1.0 inch and 0.69 inch, respectively. This exemplary core is designated as a big core for comparative purposes herein, and has a suitable axial length $L_1$ which is 3.25 inches for example.

The big core 10*a* further includes a plurality of ribs 18*a* which are in the form of relatively thin, flat plates which extend axially for the full length $L_1$ of the big core 10*a* coextensively with both the inner and other tubes 14*a* and 16*a*. The ribs 18*a* extend radially between, and are integrally joined with, the inner and outer tubes 14*a* and 16*a*, and are preferably equiangularly circumferentially spaced apart from each other to define empty pockets 20*a* therebetween. The ribs 18*a* are identical to each other and have a rib thickness $T_r$ measured in the circumferential direction.

Each of the pockets 20*a* is bounded on four sides by an adjacent pair of the ribs 18*a* and respective portions of the inner and outer tubes 14*a* and 16*a* extending therebetween to define four corresponding corners 22a each having a radius of curvature R measured in the axial-sectional plane such as the end plane illustrated in FIG. 1.

The big core 10a as described to this point is substantially identical in size and configuration to an analogous conventional core, including the use of twelve equally spaced apart ribs 18a. As indicated above, the outer and inner diameters of the big core 10a are fixed according to industry specifications, with the thicknesses of the outer and inner tubes and ribs conventionally having the values indicated above in the Background section. An analogous conventional big core, however, is subject to undesirable crushing during handling and transporting in standard packaging boxes. In order to improve the crushing strength of the big core 10a, various parameters of the core have been analyzed in an attempt to maximize crushing strength while minimizing the addition of mass for maintaining low cost. As a result of this analysis, significant improvement in crushing strength has been obtained with minor added mass and little added cost of material.

More specifically, unlike the conventional cores having an inner thickness substantially less than the outer thickness, it has been determined that increasing the inner thickness $T_i$ is a primary factor in improving core strength, and furthermore, that increasing the outer thickness $T_o$ has a negative effect on core strength. It has also been determined that increasing the corner radii R also improves core strength. It has also been determined that increasing the thickness $T_r$ of the ribs 18a also improves the core strength, but the effect thereof is minor compared to that of increasing the inner thickness $T_i$ and the corner radii R. And, the standard number of ribs 18a, i.e., 12, provides optimum core strength, and therefore a change in the number of ribs 18a is not required.

In particular, it has been determined that making the inner thickness $T_i$ at least as large as, or greater than or equal to, the outer thickness $T_o$ substantially increases core strength and crushing resistance. In accordance with one embodiment of the present invention, the thicknesses of the inner and outer tubes 14a, 16a, and the corner radii are preferably about 21 mils, 21 mils, and 36 mils, respectively. The corner radii R of the pockets 20a are preferably at least about 50% greater than the inner thickness T*i*, and in the exemplary embodiment are about 70% larger. The db thickness $T_r$ maintains its conventional value of 16 mils, with the length $L_1$, outer diameter $D_o$, and inner diameter $D_i$ also having conventional values as indicated above.

In the preferred embodiment, the corner radii R at all four corners 22a are substantially equal to each other and are preferably greater than the outer thickness $T_o$, preferably greater than the inner thickness $T_i$, and preferably greater than both the inner and outer thickness, respectively. As the exemplary values specified above indicate, the inner thickness $T_i$ is substantially equal to the outer thickness $T_o$ for the big core 10a.

Figure 2:
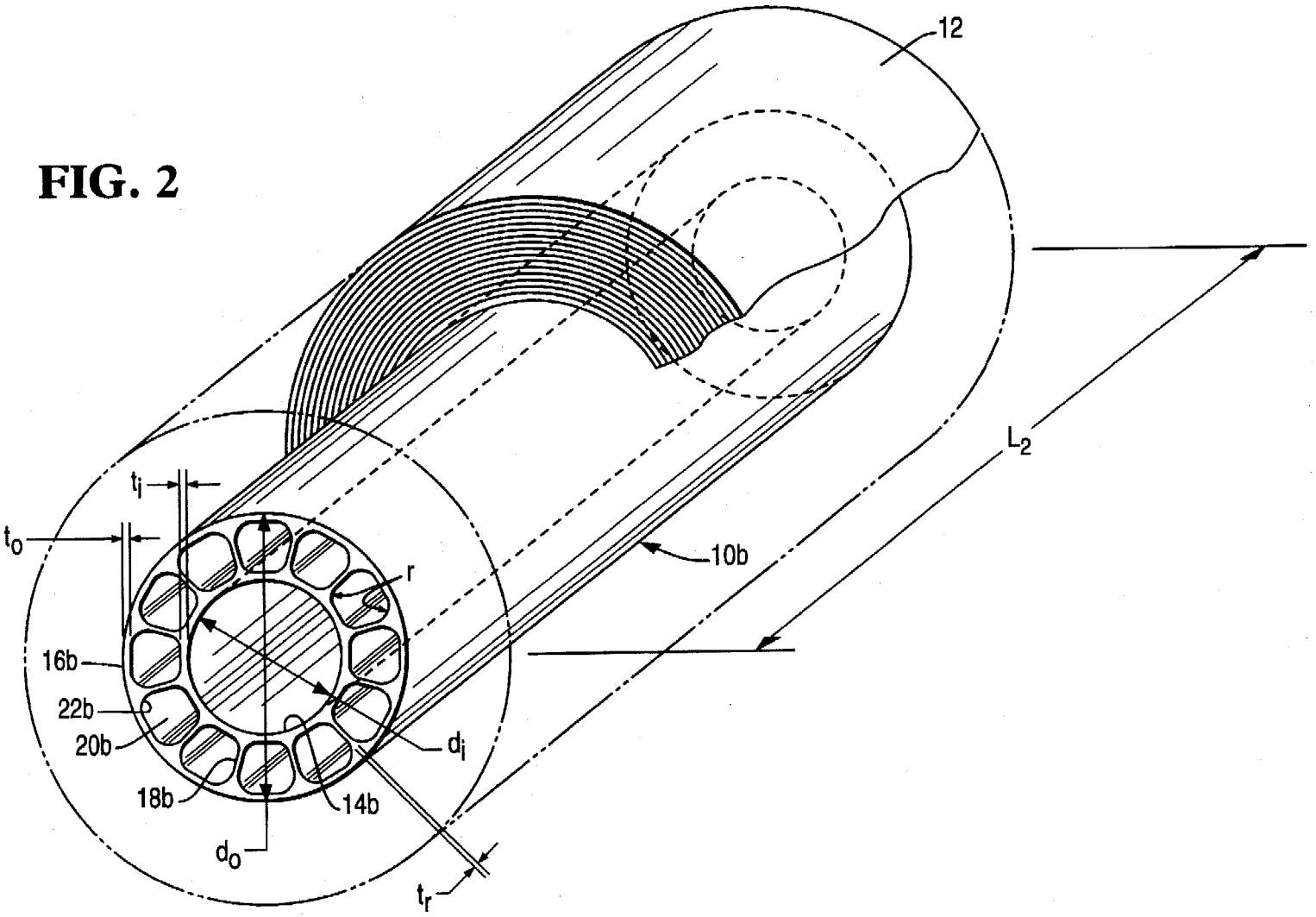
FIG. 2 is an isometric view of a radial extrusion small core in accordance with another embodiment of the present invention having a portion of a paper roll therein.

Illustrated in FIG. 2 is another embodiment of the present invention for a small core 10b having similarly configured concentric inner and outer tubes 14b and 16b, with ribs 18b extending therebetween to define corresponding pockets 20b, each having four corners 22b. The small core 10b is so designated since it is smaller than the big core 10a, and the corresponding outer diameter $d_o$ is 0.85 inch and the inner diameter $d_i$ is 0.45 inch which are industry standard values. The small core 10b has a length $L_2$ which is 2.75 inches. And, the small core 10b is also used for supporting a corresponding roll of paper 12 therearound.

Like the big core 10a, the small core 10b preferably also has twelve of the ribs 18b equiangularly spaced apart from each other. However, since the outer and inner diameters of the small core 10b are correspondingly smaller than those of the big core 10a, the corresponding pockets 20b are shorter in circumferential extent and are generally square in configuration as opposed to the generally rectangular pockets 20a illustrated in FIG. 1.

In order to provide maximum core strength for the small core 10b for withstanding crushing forces, it has been determined that the inner thickness $t_i$, outer thickness $t_o$ and corner radii r should preferably have values of about 27 mils, 21 mils, and 55 mils, respectively, in accordance with the present invention. The thickness $t_r$ of the ribs 18b have a conventional value of 15 mils in this exemplary embodiment.

The small core 10b therefore has an inner thickness $t_i$ which is preferably larger than the outer thickness $t_o$, and in the exemplary embodiment is at least about 25% greater than the outer thickness $t_o$, and in particular 28%. The corner radii r of the pockets 20b are preferably greater than the outer thickness $t_o$, preferably greater than the inner thickness $t_i$, and preferably greater than both the inner and outer thicknesses $t_i$ and $t_o$, respectively. And, the corner radii r of the pockets 20b are preferably also about twice as large as the inner thickness $t_i$.

Suitable manufacturing tolerances may be provided for each of the various dimensions of the cores. In accordance with conventional practice, the inner and outer diameters have a tolerance of ±10 mils; the inner and outer thicknesses have a tolerance of ±5 mils; and the rib thickness has a tolerance of ±5 mils. However, although the conventional tolerance on the pocket corner radii is typically ±2 mils, in accordance with the present invention, the preferred tolerance on the corner radii R and r is preferably +4 mils and −0 mils. The cores are extruded from a conventional material such as high impact polystyrene extrusion grade plastic.

Both the big and small cores 10a and 10b may be formed by any suitable process including conventional extrusion for obtaining the specified dimensions. Since the small core 10b has a substantially larger inner thickness $t_i$ than its outer thickness $t_o$, suitable care should be exercised for obtaining uniform cooling after the extrusion process to ensure acceptable roundness of the core upon solidification.

Whereas conventional big and small cores are subject to crushing damage when dropped in their packaging boxes from the average unloading height of 36.75 inches, the improved paper wound big and small cores 10a and 10b dropped from the same height experience crush-proof performance. The improved cores therefore have improved core strength against the crushing loads with relatively small increases in mass thereof, e.g. 28% mass increase for the big core 10a and 40% mass increase for the small core 10b, for minimizing manufacturing costs associated therewith. The present invention may be extended to other commonly used standard extrusion cores as desired for improving core strength without substantially increasing the mass thereof.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A core for a paper roll comprising:

an inner tube having an inner diameter and a radial wall inner thickness;

an outer tube having an outer diameter and a radial wall outer thickness, and disposed coaxially with said inner tube and spaced radially outwardly therefrom;

a plurality of ribs extending radially between and integrally joined with said inner and outer tubes, and circumferentially spaced apart from each other to define empty pockets therebetween;

each of said pockets being bounded on four sides by an adjacent pair of said ribs and respective portions of said inner and outer tubes extending therebetween to define four corresponding corners each having a radius which is greater than said outer thickness; and said inner thickness being at least as large as about said outer thickness for increasing crushing resistance of said core.

2. A core for a paper roll comprising:

an inner tube having an inner diameter and a radial wall inner thickness;

an outer tube having an outer diameter and a radial wall outer thickness, and disposed coaxially with said inner tube and spaced radially outwardly therefrom;

a plurality of ribs extending radially between and integrally joined with said inner and outer tubes, and circumferentially spaced apart from each other to define empty pockets therebetween;

each of said pockets being bounded on four sides by an adjacent pair of said ribs and respective portions of said inner and outer tubes extending therebetween to define four corresponding corners each having a radius which is greater than said inner thickness; and said inner thickness being at least as large as about said outer thickness for increasing crushing resistance of said core.

3. A core for a paper roll comprising:

an inner tube having an inner diameter and a radial wall inner thickness;

an outer tube having an outer diameter and a radial wall outer thickness, and disposed coaxially with said inner tube and spaced radially outwardly therefrom;

a plurality of ribs extending radially between and integrally joined with said inner and outer tubes, and circumferentially spaced apart from each other to define empty pockets therebetween;

each of said pockets being bounded on four sides by an adjacent pair of said ribs and respective portions of said inner and outer tubes extending therebetween to define four corresponding corners each having a radius which is greater than both said inner and outer thicknesses, respectively; and said inner thickness being at least as large as about said outer thickness for increasing crushing resistance of said core.

4. A core for a paper roll comprising:

an inner tube having an inner diameter and a radial wall inner thickness;

an outer tube having an outer diameter and a radial wall outer thickness, and disposed coaxially with said inner tube and spaced radially outwardly therefrom;

a plurality of ribs extending radially between and integrally joined with said inner and outer tubes, and circumferentially spaced apart from each other to define empty pockets therebetween;

each of said pockets being bounded on four sides by an adjacent pair of said ribs and respective portions of said inner and outer tubes extending therebetween to define four corresponding corners each having a radius which is greater than said outer thickness; and said inner thickness is substantially equal to said outer thickness for increasing crushing resistance of said core.

5. A core for a paper roll comprising:

an inner tube having an inner diameter and a radial wall inner thickness;

an outer tube having an outer diameter and a radial wall outer thickness, and disposed coaxially with said inner tube and spaced radially outwardly therefrom;

a plurality of ribs extending radially between and integrally joined with said inner and outer tubes, and circumferentially spaced apart from each other to define empty pockets therebetween;

each of said pockets being bounded on four sides by an adjacent pair of said ribs and respective portions of said inner and outer tubes extending therebetween to define four corresponding corners each having a radius which is greater than said inner thickness; and said inner thickness is substantially equal to said outer thickness for increasing crushing resistance of said core.

6. A core for a paper roll comprising:

an inner tube having an inner diameter and a radial wall inner thickness;

an outer tube having an outer diameter and a radial wall outer thickness, and disposed coaxially with said inner tube and spaced radially outwardly therefrom;

a plurality of ribs extending radially between and integrally joined with said inner and outer tubes, and circumferentially spaced apart from each other to define empty pockets therebetween;

each of said pockets being bounded on four sides by an adjacent pair of said ribs and respective portions of said inner and outer tubes extending therebetween to define four corresponding corners each having a radius which is greater than both said inner and outer thicknesses, respectively; and said inner thickness is substantially equal to said outer thickness for increasing crushing resistance of said core.

7. A core according to claim 6 wherein said corner radius is at least about 50% greater than said inner thickness.

8. A core according to claim 7 further comprising a roll of paper disposed around said outer tube.

9. A core for a paper roll comprising:

an inner tube having an inner diameter and a radial wall inner thickness;

an outer tube having an outer diameter and a radial wall outer thickness, and disposed coaxially with said inner tube and spaced radially outwardly therefrom;

a plurality of ribs extending radially between and integrally joined with said inner and outer tubes, and circumferentially spaced apart from each other to define empty pockets therebetween;

each of said pockets being bounded on four sides by an adjacent pair of said ribs and respective portions of said inner and outer tubes extending therebetween to define four corresponding corners each having a radius which; and wherein said inner thickness is greater than said outer thickness.

* * * * *